US010035683B2

(12) United States Patent
Steiner et al.

(10) Patent No.: US 10,035,683 B2
(45) Date of Patent: Jul. 31, 2018

(54) ELEVATOR SYSTEM

(71) Applicant: Inventio AG, Hergiswil (CH)

(72) Inventors: Adrian Steiner, Inwil (CH); Christoph Schuler, Steinhausen (CH); Nicolas Gremaud, Moris Plains, NJ (US); René Strebel, Sarmenstrof (CH); Urs Schaffhauser, Root (CH); Marcel Nicole, Stansstad (CH)

(73) Assignee: INVENTIO AG, Hergiswil (CH)

( * ) Notice: Subject to any disclaimer, the term of this patent is extended or adjusted under 35 U.S.C. 154(b) by 121 days.

(21) Appl. No.: 15/039,053

(22) PCT Filed: Nov. 18, 2014

(86) PCT No.: PCT/EP2014/074915
§ 371 (c)(1),
(2) Date: May 25, 2016

(87) PCT Pub. No.: WO2015/082210
PCT Pub. Date: Jun. 11, 2015

(65) Prior Publication Data

US 2017/0158465 A1 Jun. 8, 2017

(30) Foreign Application Priority Data

Dec. 5, 2013 (EP) ..... 13195845

(51) Int. Cl.
*B66B 11/02* (2006.01)

(52) U.S. Cl.
CPC ..... *B66B 11/02* (2013.01); *B66B 11/028* (2013.01); *B66B 11/0266* (2013.01)

(58) Field of Classification Search
CPC ..... B66B 11/022; B66B 11/0213; B66B 11/0286; B66B 11/02; B66B 11/0266; B66B 11/028
See application file for complete search history.

(56) References Cited

U.S. PATENT DOCUMENTS

2006/0163006 A1* 7/2006 Strebel ..... B66B 1/42 187/249
2009/0120724 A1* 5/2009 Fargo ..... B66B 9/00 187/257

(Continued)

FOREIGN PATENT DOCUMENTS

JP H10236753 A 9/1998
JP H11228058 A 8/1999

(Continued)

OTHER PUBLICATIONS

English Machine Translation of JP 2003-146561 A.*

*Primary Examiner* — William E Dondero
*Assistant Examiner* — Diem M Tran
(74) *Attorney, Agent, or Firm* — William J. Clemens; Shumaker, Loop & Kendrick, LLP

(57) ABSTRACT

An elevator system includes a first elevator car, a second elevator car, a drive-machine, and a suspension apparatus that passes over a traction sheave of the drive-machine to cause the cars to travel one above the other in a travel space. The suspension apparatus is divided into a first set and a second set. A displacement mechanism fixed in the travel space interacts with the second set between the traction sheave and the second car to vary the distance between the cars. This distance can be adjusted independent of the traction sheave. The displacement mechanism can have a pulley arrangement with a displaceable pulley displaced by a displacement drive to vary a length of a section of the second set between the displacement mechanism and the second car.

13 Claims, 3 Drawing Sheets

(56) References Cited

U.S. PATENT DOCUMENTS

| | | | | |
|---|---|---|---|---|
| 2012/0097484 | A1* | 4/2012 | Cortona | B66B 11/022 187/249 |
| 2012/0318614 | A1* | 12/2012 | Husmann | B66B 1/42 187/249 |
| 2015/0122591 | A1* | 5/2015 | Kato | B66B 11/022 187/401 |

FOREIGN PATENT DOCUMENTS

| | | | | |
|---|---|---|---|---|
| JP | 2003146561 | A | 5/2003 | |
| WO | WO-0238482 | A1 * | 5/2002 | B66B 5/12 |
| WO | 2005014461 | A1 | 2/2005 | |
| WO | WO-2011082896 | A1 * | 7/2011 | B66B 1/42 |
| WO | WO-2016006056 | A1 * | 1/2016 | B66B 5/02 |
| WO | WO-2016087532 | A1 * | 6/2016 | B66B 1/425 |

* cited by examiner

ELEVATOR SYSTEM

FIELD

The invention relates to an elevator system with a first elevator car and at least a second elevator car, which are preferably arranged in an elevator-car frame of the elevator system. The invention particularly relates to the field of elevator systems which are embodied as so-called double-decker elevator systems.

BACKGROUND

Known from WO 2005/014461 A1 is an elevator with two elevator cars, wherein the two elevator cars are mutually coupled in such manner that they are movable together in an elevator hoistway. Therein, through movement of at least one elevator car in relation to the other elevator car, a vertical distance between the two elevator cars can be adjusted. Serving this purpose is an adjusting rope, one end of the adjusting rope being fastened to the hoistway floor. At the other end of the adjusting rope, a counterweight hangs. Further, the adjusting rope is passed over a traction sheave of an adjusting drive, which comprises an elevator machine. This elevator machine is provided in addition to a further elevator machine, wherein the further elevator machine serves to move the entire arrangement with the two elevator cars through the elevator hoistway.

The elevator system which is known from WO 2005/014461 A1 has the disadvantage that, effectively, two complete arrangements with elevator machines and counterweights, as well as the related necessary diverter pulleys, are required, in order, firstly, to enable the joint movement of the two elevator cars through the elevator hoistway and, secondly, to realize the displacement mechanism for adjustment of the distance between the two elevator cars. Therein, the elevator machine, which enables the movement of the two elevator cars through the hoistway, must be so powerful that it alone can move the double-decker arrangement with the two elevator cars. Further, the drive machine that is provided for changing the distance must be sufficiently powerful to assure the mutual relative movement of the two elevator cars also under unfavorable loading conditions of the two elevator cars. The relevant components, including the suspension means, or ropes, respectively, must also be designed for a correspondingly high performance capability. The overall result is hence a high outlay, a large space requirement and, associated therewith, high costs for the realization.

SUMMARY

The task of the invention is to create an elevator system which has an improved construction. It is especially a task of the invention to create an elevator system in which a mutual displacement of a plurality of elevator cars in optimized manner is enabled, and/or, in an elevator-car frame which may be provided, the forces that act on the suspension of the elevator-car frame and in the elevator-car frame are reduced.

Following below, solutions and proposals for a corresponding elevator system are presented, which solve at least parts of the set task. In addition, advantageous augmentary or alternative further developments and embodiments are presented.

The elevator system has a first elevator car and a second elevator car. Further elevator cars can also be provided. At least one of the elevator cars, in particular the second elevator car, is displaceable relative to the first elevator car regarding the distance that lies between them. Following below, the method of functioning of the displacing mechanism that is provided for this purpose is described, which enables a displacement of the second elevator car relative to the first elevator car. Corresponding adaptations and augmentations are conceivable, in order to displace also further elevator cars, either individually or together, through at least one further displacement mechanism. In an embodiment in which only the first elevator car and the second elevator car, but no further elevator cars, are provided, a so-called double-decker elevator system can be realized.

In an advantageous embodiment of the elevator system, the traveling space that is provided for the travel of the elevator cars can be arranged in an elevator hoistway. The drive-machine unit can then also be arranged in the elevator hoistway. However, the drive machine can also be accommodated in a separate machine room. The displacement mechanism can then in advantageous manner also be accommodated in the elevator hoistway or in the machine room. However, it is also conceivable that the drive-machine unit is accommodated, for example, in a machine room, whereas the displacement mechanism is accommodated in the elevator hoistway. In this manner, depending on local conditions, in particular the space that is available, a suitable solution can be realized. This results in a wide application range.

The suspension means are divided into a first suspension-means set, a second suspension-means set, and, if need be, into at least one further suspension-means set. The suspension means can be any known suspension apparatus such as ropes or belts. For example, the suspension means or apparatus can be formed of six ropes. The first suspension-means set can then contain, for example, three of these ropes, while the second suspension-means set contains the other three ropes. However, not only an equal, but also an unequal distribution regarding the number of suspension means in the individual suspension-means sets, is possible. Also conceivable is that at least one of the suspension-means sets consists of only one suspension means, in particular of one rope.

The suspension means are passed in suitable manner over the traction sheave of the drive-machine unit. The traction sheave can have a corresponding number of grooves. The term "traction sheave" is not restricted to a monolithic traction sheave. If it is expedient, also a plurality of sheaves can be arranged mutually adjacent on the axle of the drive-machine unit over which the suspension means pass. The function of the traction sheave is hence to be understood as being to transfer the driving torque of the drive-machine unit to the suspension means.

In addition to the function of transferring the force, or torque, of the drive-machine unit, the suspension means can also have the function of supporting the elevator cars. As travel of the elevator car in the travel space that is provided is, in particular, a lifting or lowering to be understood. However, an embodiment as inclined elevator is also conceivable.

In advantageous manner, the displacement mechanism interacts with the second suspension-means set in such manner that a length of a section of the second suspension-means set between the displacement mechanism and the second elevator car is variable. Thereby, except for a movement that is caused by a rotation of the traction sheave, the second elevator car can be displaced nearer to, or farther away from, the displacement mechanism. By this means, the distance of the second elevator car from the first elevator car then changes.

Preferable is also that the displacement mechanism has a pulley arrangement through which the second suspension-means set passes and thereby forms a free loop. The pulley arrangement has at least one displaceable pulley which, preferably in the area of the free loop, interacts with the second suspension-means set. Through a displacement of the displaceable pulley, a longer section, and, hence, a greater part, of the second suspension-means set can be pulled into the pulley arrangement. Correspondingly, in the converse case, the second suspension-means set can also be at least partly released again from the pulley arrangement. This results in a variable portion of the second suspension-means set which passes through the displacement mechanism, while the first suspension-means set remains unaffected thereby. Thanks to the passage of the second suspension-means set through the displacement device as a free loop, the portion of the second suspension-means set that passes through the pulley arrangement of the displacement mechanism is variable, independent of a rotational movement of the traction sheave, and hence, in particular, also of a stationary traction sheave. This results in the advantage that the distance between the first and the second elevator car is adjustable already before a raising or lowering of the first and of the second elevator cars by the traction sheave. This advantage particularly applies if the length of the section of the second suspension-means set is only variable in the area of the free loop of the second suspension-means set.

Here to be understood as a free loop of the second suspension-means set is a section of the suspension-means set which passes through the pulley arrangement of the displacement mechanism. By this means, this section is diverted and guided to a plurality of pulleys of the pulley arrangement, wherein each pulley that is in contact with this section, is borne independently rotatably. By this means it is achieved that this section of the suspension-means set is freely movable.

The first suspension-means set and the second suspension-means set can therefore pass over the traction sheave together. After the displacement by the displacement mechanism has taken place, the rotation of the traction sheave then results in a uniform movement, in particular raising or lowering, of the elevator cars while retaining the set mutual distance between the elevator cars.

This also results in the advantage that the load of the first elevator car is borne by the first suspension-means set while the load of the second elevator car is borne by the second suspension-means set. If an elevator-car frame is provided into which the first elevator car is rigidly fastened, the first suspension-means set can, for example, be connected with the elevator-car frame. Since the second suspension-means set is connected with the second elevator car, this results in a reduction in the mechanical loading of the elevator-car frame. Hence, in this respect, with regard to its strength, the elevator-car frame can be designed with reduced requirements. This permits an inexpensive embodiment. For this purpose, the elevator-car frame requires no special modification, so that the constructional outlay is low. In advantageous manner, at least one guiderail can be provided in the elevator-car frame on which the second elevator car can be caused by the displacement mechanism to travel relative to the elevator-car frame. Then, the relative positioning of the second elevator car relative to the first elevator car is predefined when the distance is adjusted through the displacement mechanism. However, except for the guiding forces, no additional load is transferred by the second elevator car to the elevator-car frame.

This further results in the advantage that the displacement mechanism can be, for example, rigidly mounted on a hoistway wall or in a machine room. Hence, no components, in particular pulleys or suchlike, are necessary, which must be mounted on the elevator-car frame in order to realize the displacement mechanism. This results in a further relief of the suspension and hence in reduced demands on the drive-machine unit.

It also results in the advantage that, with a drive-machine unit, the actuation of both elevator cars is possible, in order to cause the latter to travel in the travel space that is provided. Different from a solution in which the two elevator cars are caused to travel by drive-machine units that are mutually separated, this results in a substantial reduction of the costs and in an improvement in safety, since collisions are ruled out from the outset. By this means, the displacement mechanism, in particular the pulley arrangement of the displacement mechanism, can also be embodied in such manner that, in the extreme position, in which the two elevator cars are closest, a safety distance is still assured.

Advantageous is for the displacement mechanism to have a displacement drive to displace at least one displaceable pulley of the pulley arrangement. Also advantageous is for the pulley arrangement to be embodied in such manner that, through a displacement of a displaceable pulley of the pulley arrangement, a length of a section of the second suspension-means set is variable within the pulley arrangement. By this means, in particular with a single displaceable pulley, a displacement mechanism can be realized with low constructional outlay.

Further advantageous is that the displacement drive of the displacement mechanism is embodied as a hydraulic displacement drive. The displacement drive can also be embodied as a pneumatic displacement drive. Further, the displacement drive can have a gear, in particular a worm gear, and/or a linear motor. If a plurality of displacement drives, for example for two or more displaceable elevator cars, are provided, a combination of different displacement drives is, in principle, conceivable.

Advantageous is for a guide to be provided in which the displaceable pulley of the pulley arrangement is guided. By this means, in advantageous manner the guide can be provided as liner guide, so that the axis of rotation of the pulley is moveable in a straight line which is aligned perpendicular to the axis of the pulley. By this means, the displaceable pulley of the pulley arrangement is linearly guided. In particular, the guide can thereby be embodied as a horizontal guide, in which the displaceable pulley of the pulley arrangement is guided horizontally. The pulley of the pulley arrangement is thereby movable horizontally and perpendicular to the axis of the pulley. Through movement of the displaceable pulley along the guide, in particular the linear guide or the horizontal guide, the section of the second suspension-means set can be varied within the pulley arrangement in advantageous manner. Alternatively, the guide can be embodied as a vertical guide in which the displaceable pulley of the pulley arrangement is guided vertically.

Hereby, it is also advantageous for the pulley arrangement to have an upper pulley and a lower pulley which, in the projection onto an axis along which the section of the second suspension-means set between the displacement mechanism and the second elevator car extends, are arranged sequentially, and for the displaceable pulley of the pulley arrangement to be arranged in the projection onto this axis between the upper pulley and the lower pulley. Hereby, the respective angle of wrap on the upper pulley and the lower pulley can, in particular, be an acute angle (i.e. less than 90°). In particular, with only three pulleys, namely the upper pulley, the lower pulley and the displaceable pulley, the pulley arrangement can be realized. Also advantageous is that the displaceable pulley is displaceable into a displaced position between the upper pulley and the lower pulley. This means that the angle of wrap on the upper pulley and the angle of wrap on the lower pulley then become relatively small but nonetheless substantially greater than 0°. Hence, in this displaced position, the additional length of the second suspension-means set relative to a straight-line path of the second suspension-means set, which, without the pulley arrangement, would run somewhat apart from the first suspension-means set, is small, and, at the same time, a measured response to displace the displaceable pulley by means of the displacement drive can still take place.

In a possible embodiment, an elevator-car frame is provided wherein, in advantageous manner, the first elevator car is arranged in the elevator-car frame and wherein the second elevator car is guided on at least one guiderail which is connected with the elevator-car frame. In this embodiment, also more than one, in particular two, guiderails can be a component of the elevator-car frame. The first suspension-means set can then be connected in advantageous manner with the elevator-car frame, whereby the first elevator car is arranged in locationally fixed manner relative to the elevator-car frame.

In this embodiment, it is also advantageous that the second suspension-means set is connected with the first elevator car and that the second elevator car is capable of being caused by the displacement mechanism to travel relative to the elevator-car frame along the one guiderail, or the guiderails, of the elevator-car frame.

DESCRIPTION OF THE DRAWINGS

Preferred exemplary embodiments of the invention are expounded in more detail in the following description by reference to the attached drawings, in which identical elements are referenced with identical numbers. Shown are in.

DETAILED DESCRIPTION

Figure 1:
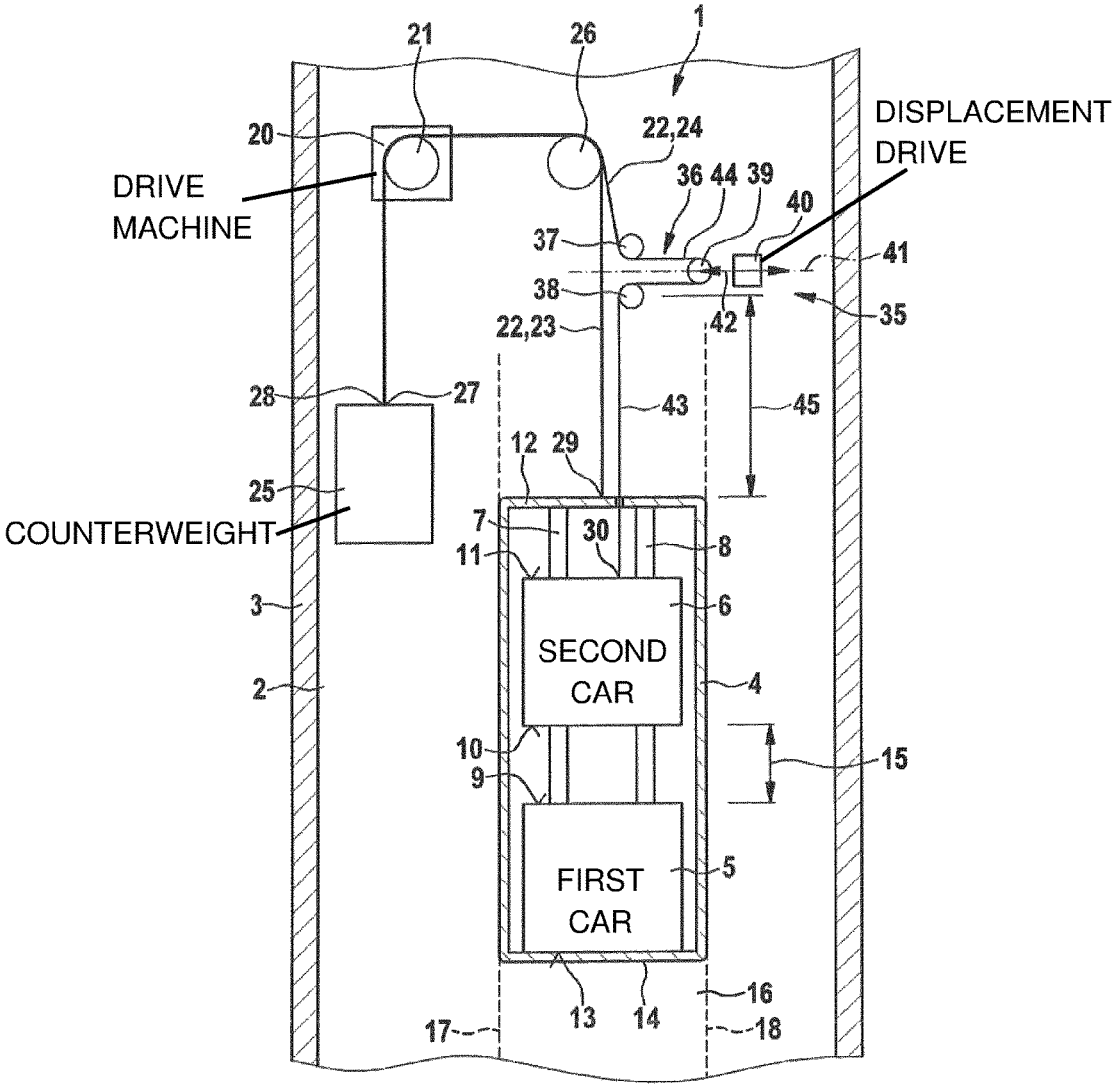
FIG. 1 an elevator system in an elevator hoistway in a partial, diagrammatic representation corresponding with a first exemplary embodiment of the invention.

FIG. 1 shows an elevator system 1 in an elevator hoistway 2 of a building 3 in a partial, diagrammatic representation according to a first exemplary embodiment. The elevator system 1 has an elevator-car frame 4, a first elevator car 5, and a second elevator car 6. The elevator cars 5, 6 are arranged in the elevator-car frame 4. In this exemplary embodiment, both the first elevator car 5 and the second elevator car 6 are arranged within the elevator-car frame 4. The first elevator car 5 is rigidly connected with the elevator-car frame 4. The first elevator car 5 is therefore arranged locationally fixed relative to the elevator-car frame 4.

In this exemplary embodiment, the elevator-car frame 4 has guiderails 7, 8. In this exemplary embodiment, the second elevator car 6 is movable within the elevator-car frame 4. In this situation, a certain safety distance between the upper side 9 of the first elevator car 5 and a lower side 10 of the second elevator car 6 is given. Further, a certain safety distance between an upper side 11 of the second elevator car 6 and an upper lateral strut 12 of the elevator-car frame 4 is given. Further in this exemplary embodiment, the first elevator car 5 rests with its lower side 13 against a lower lateral strut 14 of the elevator-car frame 4.

In this exemplary embodiment, the second elevator car 6, which is movable within the elevator-car frame 4, is guided on the guiderails 7, 8. A positioning of the two elevator cars 5, 6 relative to each other is thereby assured at all times, however, a distance 15 between the two elevator cars 5, 6 is still capable of change. Here, the distance 15 is defined as the distance 15 between the upper side 9 of the first elevator car 5 and the lower side 10 of the second elevator car 6. However, the distance 15 can also be determined by other means. For example, the distance 15 can be regarded not only as a vertical distance 15, as in this exemplary embodiment, but also as a distance 15 to be measured diagonally, as can be expedient, for example, in an inclined elevator.

Provided in the elevator hoistway 2 is a travel space 16 whose lateral boundaries 17, 18 are represented by broken lines. In a movement through the elevator hoistway, the elevator-car frame 4, with the elevator cars 5, 6, travels through this free space 16.

The first elevator car 5 and the second elevator car 6 can hence be caused to travel one above the other through the travel space 16 which is provided for the joint travel of the first elevator car 5 and the second elevator car 6. In this exemplary embodiment, the common travel capability is assured through the two elevator cars 5, 6 being situated in the elevator-car frame 4.

The elevator system 1 also has a drive machine 20. The drive machine unit 20 contains a traction sheave 21. Further, the elevator system 1 has a plurality of suspension means 22 which are separated into a first suspension-means set 23 and a second suspension-means set 24. The suspension means 22 jointly pass over the traction sheave 21. The number of suspension means 22 and the numerical separation into the suspension-means sets 23, 24, can be determined in expedient manner. A corresponding number of grooves is then provided in the traction sheave 21 in order to enable a uniform force-transmission and a fault-free operation.

The elevator system 1 also has a counterweight 25 and a diverter pulley 26. The suspension means 22 are passed over the traction sheave 21 between the counterweight 25 and the reversing pulley 26. For each individual one of the suspension means 22, and hence also for the first suspension-means set 23 and the second suspension-means set 24, in each case the same angle of wrap on the traction sheave 21 results.

An end 27 of the first suspension-means set 23 and an end 28 of the second suspension-means set 24, are connected with the counterweight 25. The other end 29 of the first suspension-means set 23 is connected with the upper lateral strut 12 of the elevator-car frame 4. The other end 30 of the second suspension-means set 24 is connected with the second elevator car 6. Further, the second suspension-means set 24 is passed in suitable manner past the upper lateral strut 12 of the elevator-car frame 4. Further, the connection of the end 29 of the first suspension-means set 23 with the upper lateral strut 12 can also take place directly. The end 29 of the first suspension-means set 23 is hence connected at least indirectly with the first elevator car 5, which, in this exemplary embodiment, is by means of the elevator-car frame 4. Further, also the end 30 of the second suspension-means set 24 is connected indirectly with the second elevator car 6. For example, the second elevator-car 6 can also be connected with a support, which is guided on the guiderails 7, 8 and is connected with the end 30 of the second suspension-means set 24.

The second elevator car 6, which is movable within the elevator-car frame 4, is not necessarily arranged above the first elevator car 5. If it is possible, inter alia, through the rope-guidance of the suspension-means sets 23, 24, the displaceable, second elevator car 6 can also be arranged below the first elevator car 5. A raising or lowering of the second elevator car 6 relative to the first elevator car 5, or relative to the elevator-car frame 4 respectively, then has the correspondingly opposite effect of reducing, or increasing, the distance 15 between the elevator cars 5, 6.

For the purpose of raising or lowering the second elevator car 6 relative to the elevator-car frame 4, the elevator system 1 has a displacement mechanism 35. In this exemplary embodiment, the displacement mechanism 35 has a pulley arrangement 36, which comprises an upper pulley 37, a lower pulley 38, and a displaceable pulley 39. In addition, the displacement mechanism 35 has a displacement drive 40, which interacts with the displaceable pulley 39. Through the displacement drive 40, a displacement of the displaceable pulley 39 along an axis 41 is possible, as is indicated by the double arrow 42.

The second suspension-means set 24 is guided by the displacement mechanism 35. The second suspension-means set 24 passes over the pulleys 37, 38, 39 of the pulley arrangement 36 and forms a free loop. A section 43 of the second suspension-means set 24 is situated between the lower pulley 38 of the pulley arrangement 36 and the second elevator car 6. When the displacement drive 40 displaces the displaceable pulley 39 along the axis 41, a section 44 of the second suspension-means set 24, which is situated in the pulley arrangement 36, becomes correspondingly longer or shorter. This affects a length 45 of the section 43 of the second suspension-means set 24. In the case of a stationary traction sheave 21, the lengthening of the section 44 results directly in a shortening of the length 45 and vice versa. The increase in the length 45 is then equal in magnitude to the shortening of the distance 15 between the elevator cars 5, 6. Conversely, the reduction in the length 45 is equal in magnitude to the increase in the distance 15 between the elevator cars 5, 6. Any rotations of the traction sheave 21 can be added thereto. The displacement mechanism 35 therefore interacts with the second suspension-means set 24 in such manner that the length 45 of the section 43 of the second suspension-means set 24 between the displacement mechanism 35 and the second elevator car 6 is variable. The displacement mechanism 35 therefore also interacts with the second suspension-means set 24 in such manner that the distance 15 between the first elevator car 5 and the second elevator car 6 is variable.

The displacement mechanism 35 is arranged in the elevator hoistway 2 in locationally fixed manner. In an adapted embodiment, the displacement mechanism 35 can also be completely or partly accommodated outside the elevator hoistway 2, in particular in a machine room. The displacement mechanism 35 is arranged in locationally fixed manner to the building 3 and relative to the travel space 16. The individual components, in particular the pulleys 37, 38 and the displacement drive 40, are fastened in suitable manner.

Figure 2:
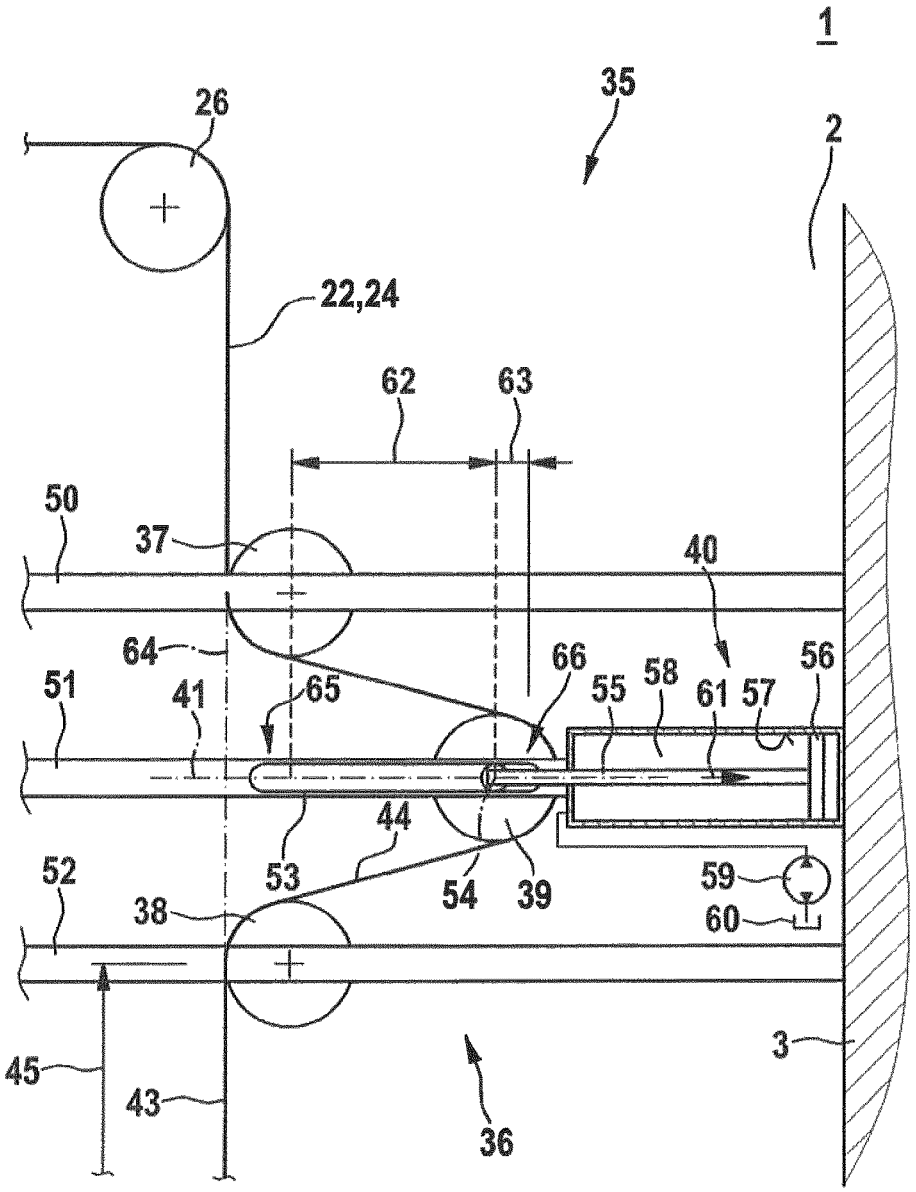
FIG. 2 a partial representation of the elevator system that is shown in FIG. 1, corresponding to the first exemplary embodiment of the invention.

The embodiment of the elevator system 1 according to the first exemplary embodiment is described further hereunder, by reference also to FIG. 2.

FIG. 2 shows a partial representation of the elevator system 1 that is shown in FIG. 1 corresponding to the first exemplary embodiment. In FIG. 2, the displacement mechanism 35, the reversing pulley 26, and the second suspension-means set 24, are shown. For better understanding, in FIG. 2 the first suspension-means set 23 is not shown. In this exemplary embodiment, fastening supports 50, 51, 52 are provided for the purpose of mounting the displacement mechanism 35 in the elevator hoistway 2. The upper pulley 37 is rotatably borne on the fastening support 50. The lower pulley 38 is rotatably borne on the fastening support 52. Provided on the fastening support 51 is a guide 53, in which an axle 54 of the displaceable pulley 39 is guided. Preferably, a two-ended guide is provided at the two ends of the axle 54. The axle 54 is then displaceable perpendicular to the axle 54 along the axis 41.

The displacement drive 40 has a rod 55, which, in this exemplary embodiment, is embodied as a pull-rod 55. The pull-rod 55 is connected with a piston 56 of the displacement drive 40, which is guided in a piston bore 57 along the axis 41. Within the piston bore 57, the piston 56 bounds a space 58. Further, the displacement drive 40 has a hydraulic pump 59 with alternating direction of rotation and a tank 60. From the tank 60, pressure-fluid can be conducted through the pump 59 into the space 58. This results in a displacement of the piston 56, and hence of the pull-rod 55, in a direction 61. In the opposite direction of rotation, the pump 59 conveys the pressure-fluid out of the space 58 into the tank 60. In the described pulley arrangement 36, through the displaceable pulley 39 and the pull-rod 55, a restoring force acts in any case opposite to the direction 61. Corresponding to the pressure-fluid which has been returned, this restoring force then correspondingly results in a return of the piston 56 opposite to the direction 61. In other words, the displacement drive 40 acts opposite to the return force of the pulley arrangement 36.

Alternatively, the hydraulic pump 59 can convey pressure-fluid backwards and forwards between the right-hand space 58 and a left-hand space which is separated from the piston 56. In this embodiment, the tank 60 can be obviated. Advantageously, the displacement drive 40 can act not only against the restoring force of the pulley arrangement 36, but also in the direction of the restoring force. The return of the piston 56 can then be actively assisted by the displacement drive 40.

When the traction sheave 21 is stationary, then, starting from the position of the displaceable pulley 39 shown in FIG. 2, a displacement can also take place both in the direction 61 and opposite to the direction 61. Hence, a displacement distance 62 opposite to the direction 61 is available. In addition, a displacement distance 63 in the direction 61 is available. Corresponding to the geometrical situation, in which inter alia the angles of wrap on the pulleys 37, 38, 39 are relevant, a displacement of the pulley 39 from the shown starting position opposite to the direction 61 converts into an increase in the length 45 of the section 43 of the second suspension-means set 24. Correspondingly, a displacement in the direction 61 converts into a reduction in the length 45 of the section 43 of the second suspension-means set 24. Provided that, when such a displacement occurs, a rotation of the traction sheave 21 is permitted by the control, this complements the joint travel of the suspension means 22, meaning the first suspension-means set 23 as well as the second suspension-means set 24. However, seen in isolation, also in the case of a rotating traction sheave 21, the displacement of the displaceable pulleys 39 of the pulley arrangement 36 results in an increase or decrease in the length 45 of the section 43 of the second suspension-means set 24, which, through the rotation of the traction sheave 21, is only amplified, compensated, or overcompensated. Relevant here is that the displacement of the displaceable pulley 39 only has an effect on the second suspension-means set 24, but not on the first suspension-means set 23. By contrast, a rotation of the traction sheave 21 acts equally both on the first suspension-means set 23 and also on the second suspension-means set 24.

In this exemplary embodiment, the guide 53 is embodied as a linear guide 53. In the linear guide 53, the pulley 39 of the pulley arrangement 36 is guided linearly, namely along the axis 41. In this exemplary embodiment, the guide 53 is embodied as horizontal guide 53. In the horizontal guide 53, the displaceable pulley 39 of the pulley arrangement 36 is guided horizontally. Self-evidently, guide 53 can also be embodied as vertical guide. In the vertical guide, the displaceable pulley 39 of the pulley arrangement 36 is guided vertically.

In an adapted embodiment of the displacement mechanism 35, in particular of the displacement drive 40, also a non-linear guide can be expedient. For example, a guidance of the displaceable pulley 39 along a curve, in particular an arc of a circle, can also be realized. Further, the guide 53 can also serve to absorb a part of the forces from the second suspension-means set 24 which act on the axle 54 of the displaceable pulley 39. Further, in an adapted embodiment, the displacement drive 40 can be embodied as a pneumatic displacement drive 40.

In this exemplary embodiment, the pulley arrangement 36 is embodied in such manner that the upper pulley 37 is arranged in a vertical extension directly above the lower pulley 38. The section 43 of the second suspension-means set 24 extends along an axis 64. The second suspension-means set 24 can also be situated on this axis 64, between the reversing pulley 26 and the upper pulley 37.

For the displaceable pulley 39, an end-position 65 near to the axis 64 is predefined. Another end-position 66 of the displaceable pulley 39 is predefined which is further from the axis 64. In this exemplary embodiment, the end-positions 65, 66 lie along the axis 41 on the same side, namely to the right of the axis 64. When these pulleys 37, 38, 39, with respect to their position, are projected onto the axis 64, then the displaceable pulley 39 is situated between the upper pulley 37 and the lower pulley 38. In this exemplary embodiment, this applies for all possible positions of the displaceable pulley 39. In the displacement position 65 that is defined by the end-position 65, the displaceable pulley 39 is arranged between the upper pulley 37 and the lower pulley 38. For this purpose, the pressure-fluid is largely transported out of the space 58 into the tank 60, until the displaceable pulley 39 is displaced into the displaced position between the upper pulley 37 and the lower pulley 38. Upon adoption of the displaced position 65, the lower pulley 38, the displaceable pulley 39, and the upper pulley 37 are then arranged in succession aligned to the axle 64. The angles of wrap which then occur on the pulleys 37, 38, 39 are, in the end-position 65 of the displaceable pulley 39, within the scope of the possibilities that are limited by the guide 53, in each case minimal, but not non-existent.

Hence, in advantageous manner, the rope path of the second suspension-means set 24 can be changed within the pulley arrangement 36. The change in the rope path takes place through the displacement drive 40. Since the displacement drive 40 and the pulley arrangement 36 are arranged locationally fixed in the elevator hoistway, there results thereby no increase in the masses, and hence in the weight forces, which emanate from the elevator-car frame 4 with the first elevator car 5 and the second elevator car 6. This also results in an improved distribution of the weight forces, since the elevator-car frame 4 with the first elevator car 5 is suspended on the first suspension-means set 23, while the second elevator car 6 is suspended on the second suspension-means set 24. By this means, the safety can also be increased, since also in the case of a malfunction in the area of the displacement mechanism 35, the second elevator car 6 is held reliably in the elevator hoistway 2 above the elevator-car frame 4. Should, for example, a rope slippage occur in the second suspension-means set 24, the maximum falling height of the second elevator car 6 nonetheless remains limited by its arrangement within the elevator-car frame 4.

By this means, the distance 15 between the elevator cars 5, 6 can be varied in advantageous manner. Hence, in a building with different distances between stories, an adjustment of the distance 15 can take place, in order to enable a simultaneous boarding and exiting, or loading and unloading, into or out of the elevator cars 5, 6 on different, in particular adjacent, stories. Hereby, the displacement mechanism 35 can be embodied not only hydraulically or pneumatically, but also in other manner. A further possibility for embodiment of the displacement mechanism 35 is described in more detail below by reference to FIG. 3.

Figure 3:
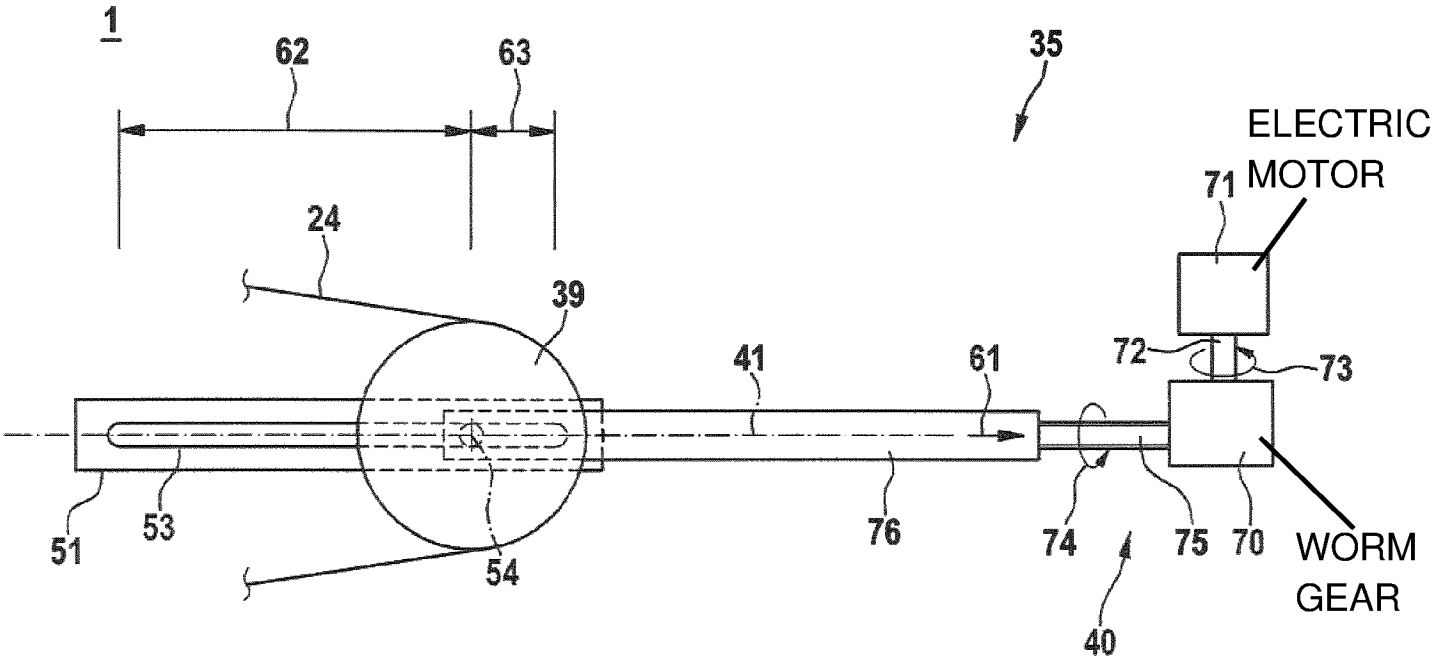
FIG. 3 a displacement mechanism of the elevator system that is shown in FIG. 1 in a partial, diagrammatic representation according to a second exemplary embodiment of the invention.

FIG. 3 shows a displacement mechanism 35 as well as the displaceable pulley 39 and the second suspension-means set 24 of the elevator system 1 according to a second exemplary embodiment in a partial, diagrammatic representation. In this exemplary embodiment, the displacement drive 40 of the displacement mechanism 35 is embodied as a mechanical displacement drive 40 with a gear which is embodied as a worm gear 70. An electric motor 71 of the displacement drive 40 generates on an output axle 72 an output torque 73. The worm gear 70 converts this output torque 73 into a torque 74 which drives a worm shaft 75. For part of its length, the worm shaft 75 is enclosed in a tube 76. The tube 76 is non-rotatable, but movable along the axis 41. The tube 76 interacts with the worm shaft 75 in such manner that, through the torque 74, a displacement of the tube 76 in the direction 61 is enabled. With a reversed direction of rotation of the electric motor 71, the tube 76 is actuated opposite to the direction 61. Thereby, a displacement of the axle 54 of the displaceable pulley 39 within the range that is given by the guide 53 is possible. This embodiment has the advantage of being largely self-locking.

In an adapted embodiment, the electric motor 71 can also be embodied as a linear motor 71, so that the worm gear 70 can be obviated. Such a linear motor 71 can then also act directly on the tube 76 or on the rod 55 (FIG. 2) respectively.

The invention is not restricted to the exemplary embodiments and adaptations that are described.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system having a first elevator car, a second elevator car, a drive machine, and a plurality of suspension means that pass over a traction sheave of the drive machine, wherein the first elevator car and the second elevator car are connected to the suspension means to be caused by the drive machine unit to travel one above the other in a travel space provided for joint travel of the first elevator car and the second elevator car, comprising:

the suspension means is divided into a first suspension-means set and a second suspension-means set; and a displacement mechanism, which mechanism is locationally fixed relative to the travel space, that interacts with the second suspension-means set between the traction sheave and the second elevator car to vary a distance between the first elevator car and the second elevator car, and wherein the distance is adjustable independent of the traction sheave, the displacement mechanism including a pulley arrangement through which the second suspension-means set passes, the pulley arrangement having a displaceable pulley engaging the second suspension-means set, the pulley arrangement having an upper pulley and a lower pulley arranged sequentially along an axis of the second suspension-means set extending between the displacement mechanism and the second elevator car, and the displaceable pulley arranged in a projection onto this axis between the upper pulley and the lower pulley.

2. The elevator system according to claim 1 wherein the displacement mechanism interacts with the second suspension-means set to vary a length of a section of the second suspension-means set between the displacement mechanism and the second elevator car.

3. The elevator system according to claim 1 wherein the second suspension-means set passes through the pulley arrangement thereby forming a free loop, wherein, in an area of the free loop, the displaceable pulley interacts with the second suspension-means set.

4. The elevator system according to claim 1 wherein the displacement mechanism includes a displacement drive for displacing the displaceable pulley.

5. The elevator system according to claim 4 wherein the displacement drive has at least one of a hydraulic displacement drive, a pneumatic displacement drive, a gear, a worm gear and a linear motor.

6. The elevator system according to claim 1 wherein the pulley arrangement varies a length of a section of the second suspension-means set within the pulley arrangement by displacement of the displaceable pulley.

7. The elevator system according to claim 1 including a guide in which the displaceable pulley is guided.

8. The elevator system according to claim 7 wherein the guide is a linear guide.

9. The elevator system according to claim 1 wherein the displacement mechanism includes a horizontal guide in which a displaceable pulley is horizontally guided, the displaceable pulley engaging the second suspension-means set.

10. The elevator system according to claim 1 wherein the displaceable pulley is displaceable into a displaced position between the upper pulley and the lower pulley.

11. The elevator system according to claim 1 including an elevator-car frame wherein the first elevator car is at least partly arranged in the elevator-car frame and the second elevator car is guided on at least one guiderail that is connected with the elevator-car frame.

12. The elevator system according to claim 11 wherein the first suspension-means set is connected with the elevator-car frame and the first elevator car is arranged locationally fixed relative to the elevator-car frame.

13. The elevator system according to claim 11 wherein the second suspension-means set is connected with the second elevator car and the displacement mechanism causes the second elevator car to travel relative to the elevator-car frame along the at-least one guiderail.

* * * * *